United States Patent [19]

Davis

[11] 4,237,403

[45] Dec. 2, 1980

[54] POWER SUPPLY FOR FLUORESCENT LAMP

[75] Inventor: Forrest W. Davis, San Luis Obispo, Calif.

[73] Assignee: Berkleonics, Inc., San Luis Obispo, Calif.

[21] Appl. No.: 30,322

[22] Filed: Apr. 16, 1979

Related U.S. Application Data

[63] Continuation-in-part of Ser. No. 860,597, Dec. 14, 1977, abandoned.

[51] Int. Cl.[3] ..... H05B 41/30; H05B 41/392

[52] U.S. Cl. ..... 315/98; 315/105; 315/205; 315/DIG. 5; 315/DIG. 7

[58] Field of Search ..... 315/98, 105, 101, 205, 315/206, DIG. 5, DIG. 7, 224

[56] References Cited

U.S. PATENT DOCUMENTS

| | | | |
|---|---|---|---|
| 2,949,565 | 8/1960 | Rohloff et al. | 315/DIG. 7 |
| 3,089,980 | 5/1963 | Neusbaum | 315/97 |
| 3,700,956 | 10/1972 | Cluett | 315/98 X |
| 3,889,153 | 6/1975 | Pierce | 315/DIG. 7 |
| 3,890,537 | 6/1975 | Park et al. | 315/DIG. 7 |

*Primary Examiner*—Alfred E. Smith
*Assistant Examiner*—Charles F. Roberts
*Attorney, Agent, or Firm*—Christie, Parker & Hale

[57] ABSTRACT

Electrical power is converted into rectangular waves, which are loosely coupled to a fluorescent lamp. A parallel tank circuit resonant near the fundamental or a harmonic of the square wave frequency is connected between the electrodes of the lamp. The electrodes of the lamp each have a pair of terminals across which an electrical potential is applied to heat the electrodes while starting the lamp. Power is applied across the first and second electrodes while starting the lamp and after starting the lamp. Power is also applied and/or the pair of terminals of the second electrode while starting the lamp and after starting the lamp. The ratio of voltage across the first and second electrodes to the voltage across the pair of terminals is such as to properly preheat the electrodes and prevent arcing between each pair of terminals, and arcing between the first and second electrodes while starting. After starting, these voltages drop to a much lower and proper value for continuous approximate sine wave operation and lamps thus have been protected and yield their longest life. In one embodiment, the power of the rectangular wave is controlled responsive to the current applied to the lamp to prevent generation of excessive power after the lamp is started.

31 Claims, 5 Drawing Figures

POWER SUPPLY FOR FLUORESCENT LAMP

CROSS REFERENCE TO RELATED APPLICATIONS

This application is a continuation-in-part of application Ser. No. 860,597, filed Dec. 14, 1977, now abandoned.

BACKGROUND OF THE INVENTION

This invention relates to fluorescent lighting systems and, more particularly, to an efficient, low cost power supply for a fluorescent lamp.

Fluorescent lamps are generally regarded as being superior to incandescent lamps in a number of respects, including the quality of the light, the efficiency of conversion of electrical power to light power, and lamp life. The principal drawbacks of fluorescent lamps in the past have been the initial high cost of lamp fixtures and electrical control circuitry, and the difficulty of adapting conventional incandescent lamp installations to accept fluorescent lamps. These drawbacks have in large measure been eliminated by the commercial availability of so-called circline fluorescent lamps and adapters therefor. Circline lamps are annular in form, generally having a $6\frac{1}{2}$ or eight inch diameter, and have a so-called rapid start capability, i.e., the two electrodes each have a pair of terminals across which an electrical potential is applied to heat the electrode while starting the lamp. As a result, the expensive electrical control circuitry required to provide the high starting voltage is avoided. Fixtures having a screw base for adapting circline lamps to incandescent lamp sockets, and fixtures having mounting sleeves for adapting circline lamps to table lamp pedestals have recently been introduced to consumers.

Conventionally, circline lamps and straight, rapid start fluorescent lamps are started by connecting the two terminals of each electrode in series with a heat activated, normally closed switch and this lamp-switch configuration in series with a suitable inductor across the source of line voltage. After a short period of time, sufficient to heat the electrodes, the switch opens to impress the line voltage plus spike voltage from the inductor between the electrodes, which starts the lamp.

SUMMARY OF THE INVENTION

According to one aspect of the invention, electrical power is converted into rectangular waves, preferably at a higher frequency than conventional line voltage. The rectangular waves are magnetically coupled to a fluorescent lamp. The magnetic coupling coefficient is sufficiently small to prevent the low impedance of the lamp after starting from loading the power converter. A parallel tank circuit resonant near the fundamental or a harmonic of the frequency of the rectangular waves is connected between the electrodes of the lamp to increase the voltage applied across the lamp electrodes during starting, then drop to a lower quasi-sine wave voltage thereafter.

According to another aspect of the invention, electrical power is applied across the electrodes of a fluorescent lamp while starting and after starting. Electrical power is also applied across a pair of terminals for each electrode while starting the lamp and after starting the lamp. The ratio of voltage across the electrodes to the voltage across the pair of terminals is such as to properly heat the electrodes and start lamp currents, yet prevent destructive arcing between each pair of terminals and between the electrodes.

A feature of the invention is an inductive voltage dividing network connected across the lamp and a selector switch through which electrical power is coupled to the voltage dividing network. The selector switch determines the extent of power division, and, therefore, the lamp intensity.

Another feature of the invention is a feedback network that reduces the power applied to the lamp after it has started responsive to a current sensing winding in series with the lamp. Preferably, power is applied to the lamp by a ringing choke oscillator, the oscillations of which are controlled by a voltage applied to the gating electrodes of SCR's; the current sensing winding is magnetically coupled to control windings connected across the gating electrodes of the SCR's to fire them sooner and reduce the power supplied to the lamps responsive to increased current through the current sensing winding.

BRIEF DESCRIPTION OF THE DRAWINGS

The features of specific embodiments of the best mode contemplated of carrying out the invention are illustrated in the drawings, in which.

DETAILED DESCRIPTION OF THE SPECIFIC EMBODIMENTS

Figure 1:
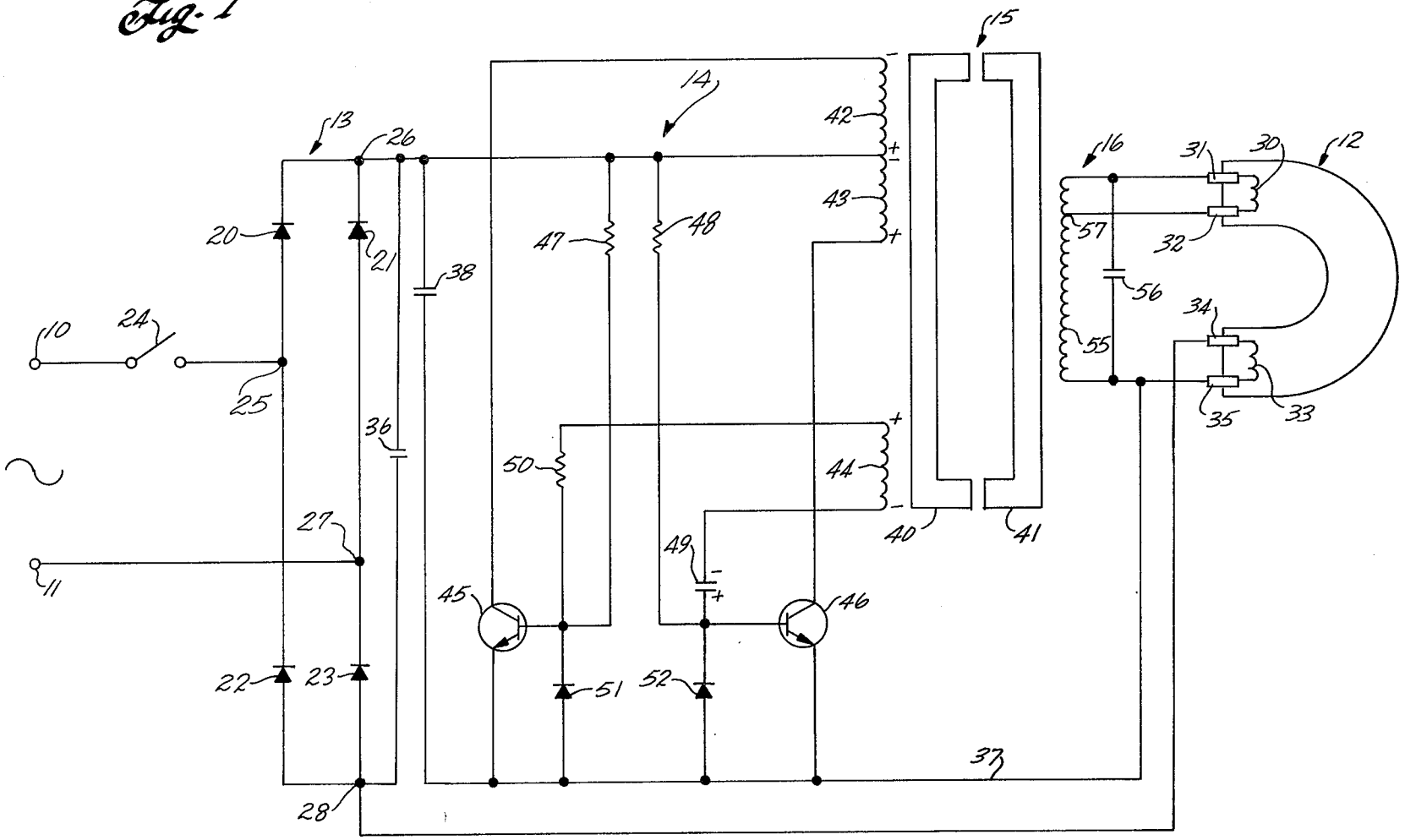
FIG. 1 is a schematic circuit diagram of one embodiment of a power supply for a fluorescent lamp incorporating principles of the invention.

In FIG. 1, a source of line voltage, i.e., 60 cycle, 110 volt alternating current power, has output terminals 10 and 11. (The high voltage terminal is line voltage terminal 10.) A fluorescent lamp 12 is energized by a power supply comprising a rectifier 13, a rectangular wave power converter 14, a transformer core 15, and a tank circuit 16 connected in tandem between line voltage output terminals 10 and 11 and fluorescent lamp 12. Rectifier 13 comprises diodes 20, 21, 22 and 23 connected in a bridge. Line voltage output terminal 10 is connected via a power ON switch 24 to an input terminal 25 or rectifier 13. Diode 20 is connected from input terminal 25 to a high voltage output terminal 26 of rectifier 13. Line voltage output terminal 11 is directly connected to an input terminal 27 of rectifier 13. Diode 21 is connected between input terminal 27 and high voltage output terminal 26. Diodes 22 and 23 are connected from a low voltage output terminal 28 to input terminals 25 and 27, respectively. Diodes 20 and 21 are poled to conduct current from line voltage output terminals 10 and 11 to output terminal 26. Diodes 22 and 23 are poled to conduct current from low voltage output terminal 28 to line voltage output terminals 10 and 11. Thus, a pulsating positive direct current potential appears at output terminal 26.

Lamp 12 is the type of fluorescent lamp having filament-type electrodes that are heated to start the lamp, such as a conventional circline fluorescent lamp. The ends of a filament-electrode 30 are connected to output terminals 31 and 32 of the power supply and the ends of a filament-electrode 33 are connected to output terminals 34 and 35 of the power supply. In the case of a circline lamp, terminals 31, 32, 34 and 35 are sockets that receive terminal pins integral with the body of the circline lamp.

A capacitor 36 is connected between output terminals 26 and 28. As a safety feature, low voltage output terminal 28 of rectifier 13 is connected to output terminal 34 and output terminal 35 is connected by a common bus 37 to one lead of a capacitor 38. The other lead of capacitor 38 is connected to high voltage output terminal 26 of rectifier 13. Thus, when the pins of circline lamp 12 are not connected to output terminals 31, 32, 34 and 35, no voltage appears thereacross, even if switch 24 is closed, because the circuit between rectifier 13 and converter 14 is completed through filament electrode 33. By placing filament-electrode 33 in series between rectifier 13 and converter 14, filament-electrode 33 also functions as a fuse. If a short circuit develops in the power supply drawing too much current from the source of line voltage, filament-electrode 33 burns out thereby opening the circuit. Similarly, this safety feature results when electrode 33 is wired in series with the AC power line prior to rectifier 13.

In the preferred embodiment, the function of filter capacitors 36 and 38 is to present a short circuit across output terminals 26 and 28 of rectifier 13 at the frequency of the rectangular waves produced by converter 14. Thus, converter 14 does not transmit interference to the source of line voltage. This frequency, which is typically of the order of 20–50 kilohertz, is substantially higher than the frequency of the line voltage. It is not necessary, nor desirable from a cost point of view, to provide for filter capacitors 36 and 38 a resultant capacitance that is large enough to filter the 60 cycle ripple at high voltage output terminal 26. The ratio of the capacitance of filter capacitors 36 to that of filter capacitor 38 is selected to provide the desired heater voltage for filament electrode 33. In some cases, filter capacitor 36 could be eliminated altogether. On the other hand, a larger resultant capacitance for capacitor 36 provides a cooler running power supply and a brighter burning lamp.

Converter 14 is basically a ringing choke oscillator. It has primary windings 42 and 43 that are wound in bifilar relationship on a primary bobbin, not shown, a feedback winding 44 which is also wound on the primary bobbin, and a secondary winding 55 that is wound on a secondary bobbin, not shown. Core 15 has U-shaped ferromagnetic core segments 40 and 41 that pass through the primary and secondary bobbins. Core segments 40 and 41 face each other with their ends spaced apart to form gaps that produce loose coupling between the primary and secondary bobbins. An NPN transistor 45 has a collector which is connected by primary winding 42 to high voltage output terminal 26 of rectifier 13 and an emitter connected to bus 37. Similarly, an NPN transistor 46 has a collector connected by a primary winding 43 to high voltage output terminal 26 and an emitter connected to bus 37. Biasing resistors 47 and 48 are connected between high voltage output terminal 26 and the base of transistor 45 and the base of transistor 46, respectively. A timing capacitor 49 and a charging resistor 50 are connected in series with feedback winding 44 between the bases of transistors 45 and 46. Diodes 51 and 52 are connected between the emitter and base of transistors 45 and 46, respectively, and are poled for current flow from emitter-to-base to protect transistors 45 and 46 from surge voltages when they are cut off. By connecting transistor protecting diodes 51 and 52 between the emitter and base rather than the emitter and collector of the transistors, thereby relying upon the base-collector junction to carry part of the surge voltage when the transistor cuts off, cheaper diodes having a lower voltage rating can be employed.

In the operation of converter 14, transistor 45 and 46 are alternately saturated and cut off with short transition times between the cut off and saturated states of the transistors. The resulting square rectangular wave operation of the transistors minimizes their power consumption. Assuming that transistor 45 is saturated and transistor 46 is cut off, the saturation is supported by current flow into the base of transistor 45, the collector current flowing through primary winding 42 rises, and a constant voltage in the polarity indicated in FIG. 1 is induced across primary winding 42. As a result of the increasing collector current flowing through primary winding 42, a constant voltage in the polarity indicated in FIG. 1 is also induced across feedback winding 44, which maintains the saturation current at the base of transistor 45 and also charges timing capacitor in the polarity indicated in FIG. 1 through charging resistor 50, the base-to-emitter junction of transistor 45, and diode 52. Capacitor 49 charges until the emitter-to-base voltage drop of transistor 45 is no longer sufficient to maintain the saturation current at the base of transistor 45. As a result, the collector current flowing through primary winding 42 begins to decrease, the polarity of the voltage induced across feedback winding 44 changes rapidly, transistor 45 cuts off, and transistor 46 becomes saturated. The described procedure is then repeated with respect to transistor 46.

When transistor 45 is saturated and transistor 46 is cut off, the collector current flowing from bus 37 through diode 52 and the base-to-collector junction of transistor 46 to primary winding 43 induces a voltage across primary winding 43 in the polarity indicated in FIG. 1 which additively combines with, and doubles, the voltage across primary winding 42. When transistor 45 cuts off, the described action is repeated with respect to primary winding.

Capacitor 49 and resistor 50 are selected so as to prevent core 15 from saturating as transistors 45 and 46 alternately saturate and cut off.

Balanced operation of a fluorescent lamp is preferable, i.e., the application thereto of alternating power having a fifty percent duty cycle. Accordingly, it is desirable for converter 14 to produce rectangular waves having a duty cycle as near as possible to fifty percent, i.e., to produce as nearly as possible square-waves.

Typically, the frequency of the rectangular waves produced by converter 14 would be of the order of 20 to 50 kilohertz. It has been discovered that such high frequency waves produce in the order of 15% more light from the fluorescent lamp for a given power consumption, permit better control of the voltage applied to the filament-electrodes of the lamp while starting and after starting to reduce the chances of arcing, and eliminates flicker at low level, because the frequency is too high to be perceived by the human eye.

Tank circuit 16 comprises secondary winding 55 and a tuning capacitor 56 in parallel. Primary windings 42 and 43, feedback winding 44, secondary winding 55, and core 15 together comprise a loosely coupled transformer. In contrast to the prior art, power is applied across filament electrodes 30 and 33 and across one or both terminal pair at all times, thus eliminating the need for a normally closed, heat activated switch. Lamp starting is aided by the maintenance of a proper ratio between the voltage across the filament electrodes and the voltage across the terminal pairs. One junction of secondary winding 55 and tuning capacitor 56 is connected to output terminal 31. The other junction of secondary winding 55 and tuning capacitor 56 is connected to output terminal 35. Secondary winding 55 has an intermediate tap 57 near one end that is connected to output terminal 32. Thus, a small portion of the voltage applied across filament-electrodes 30 and 33 is applied between output terminals 31 and 32, i.e., across filament-electrode 30 itself, at all times, i.e., while starting and after starting. Voltage is also applied across filament-electrodes 30 and 33 at all times, i.e., while starting and after starting. The ratio of voltage across filament-electrodes 30 and 33 to the voltage across output terminals 31 and 32 is controlled by component selection so as to prevent arcing between terminals 31 and 32 and arcing between the filament-electrodes while starting. While lamp 12 is starting, i.e., before a gaseous discharge is established therein, it has a high impedance and a relatively high voltage must be supplied between output terminals 31 and 32 and between output terminals 34 and 35 to heat filament-electrodes 30 and 33, respectively, and between output terminals 31 and 35. After lamp 12 has started, i.e., after the gaseous discharge is established, it has a low impedance and a relatively high current must be supplied to output terminals 31 and 35. To prevent the low impedance of lamp 12 after starting from loading converter 14 and thus distorting the rectangular waves and increasing the power consumption, core 15 loosely couples primary windings 42 and 43 to secondary winding 55. Thus, square waves can exist at the output of converter 14, while an approximate sine wave exists across tank circuit 16. Specifically, the gaps between core segments 40 and 41 are made large enough to provide a small coupling coefficient that will not substantially increase the transition time of transistors 45 and 46 between saturation and cut off after lamp 12 starts, i.e., that will not substantially increase the power consumption by transistors 45 and 46. In one embodiment, the gaps were between 0.004 and 0.006 inches. The current required to energize lamp 12 after starting places an upper limit on the number of turns of secondary winding 55 relative to the number of turns of primary windings 42 and 43. In a typical example, primary windings 42 and 43 each have 150 turns, feedback winding 44 has 8 turns, and secondary winding 55 has 67 turns. Typically, while starting, 250 to 300 volts are applied across output terminals 31 and 35. Typically, after starting, 70 to 120 volts are applied across output terminals 31 and 35. Turning capacitor 56 and secondary winding 55 are designed to resonate near the fundamental or harmonic of the frequency of the rectangular waves produced by converter 14, thereby increasing the voltage applied across output terminals 31 and 35 during starting, vis-a-vis the voltage across secondary winding 55 in the absence of tuning capacitor 56. Preferably, for the sake of stability, tuning capacitor 56 and secondary winding 55 are designed to resonate at a frequency slightly lower than the fundamental or harmonic frequency selected, although this is not optimum from the point of view of maximizing voltage while starting. After starting, the low impedance of lamp 12 loads tank circuit 16, thereby detuning it and effectively neutralizing capacitor 56. As a result, after lamp starting, the current flowing through output terminals 31 and 35 is that value dictated by the turns ratio of primary windings 42 and 43 to secondary winding 55.

To summarize, rectifier 13 produces an unfiltered, direct current that powers converter 14. Converter 14 produces high frequency rectangular waves, which permits the transistors of converter 14 to operate in a low power consuming saturation mode. Core 15 loosely couples converter 14 to lamp 12 via tank circuit 16, which is resonant near the fundamental or harmonic of the rectangular wave frequency for the purpose of boosting the voltage. As a result of the resonance, tank circuit 16 boosts the voltage applied to lamp 12 while starting. After starting, the low impedance of lamp 12 detunes tank circuit 16, but does not load converter 14 by virtue of the loose coupling provided by core 15. Consequently, the transistors of converter 14 continue to operate in the same low power consuming saturation mode after lamp 12 has started.

Figure 2:
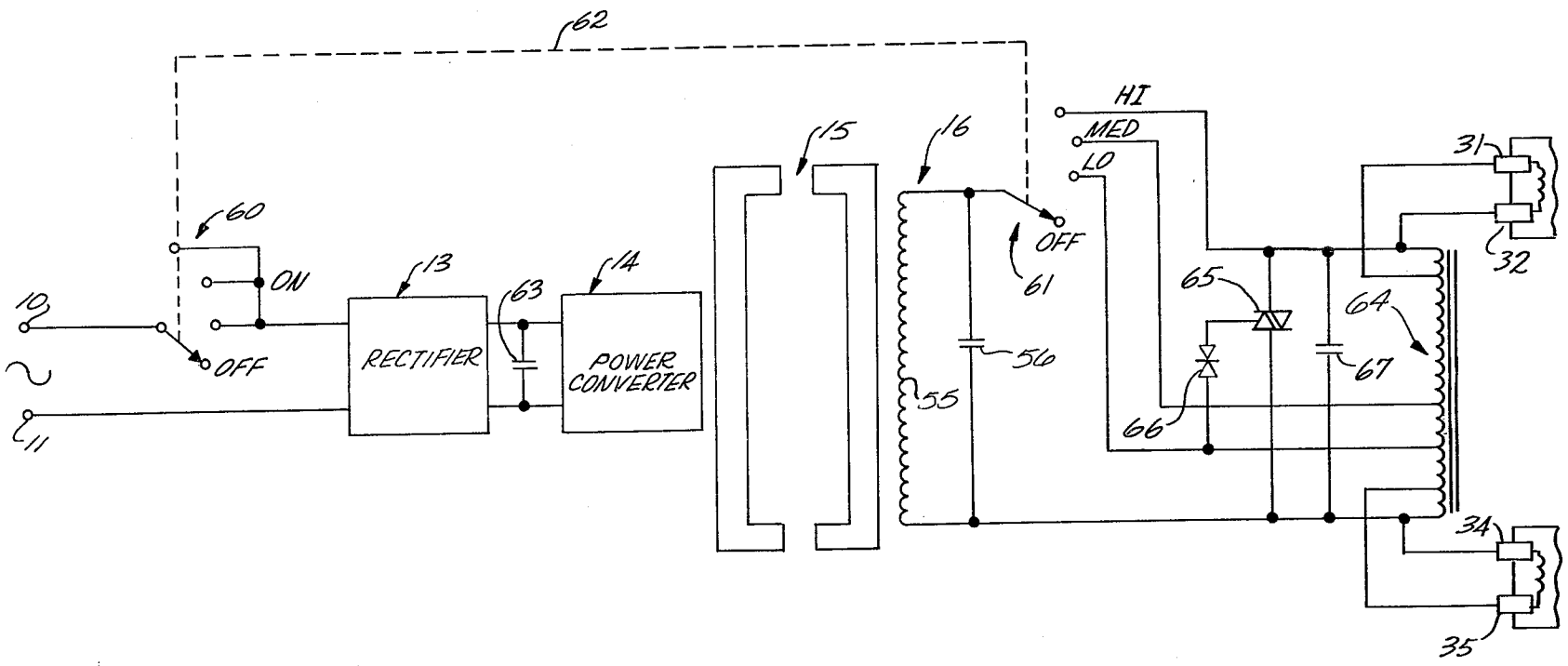
FIG. 2 is a schematic circuit diagram of another embodiment of a power supply for a fluorescent lamp incorporating principles of the invention.
Figure 3:
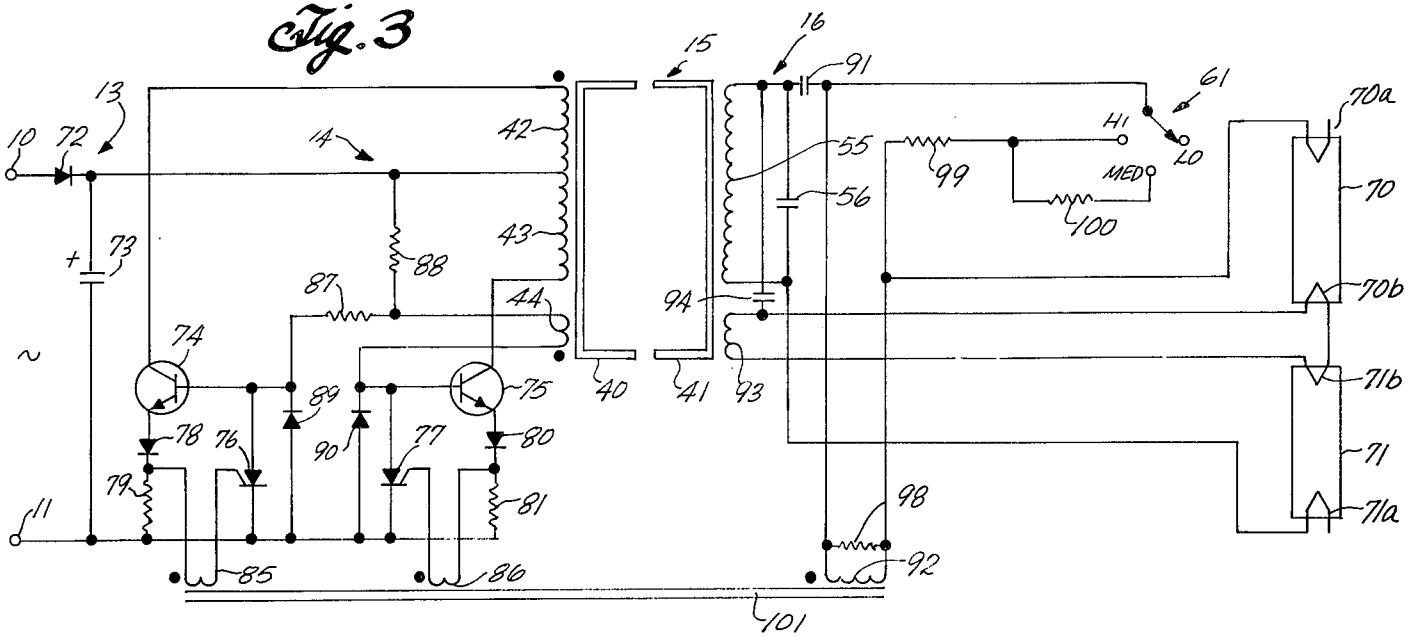
FIG. 3 is a schematic circuit diagram of still another embodiment of a power supply for a fluorescent lamp incorporating the principles of the invention.
Figure 4:
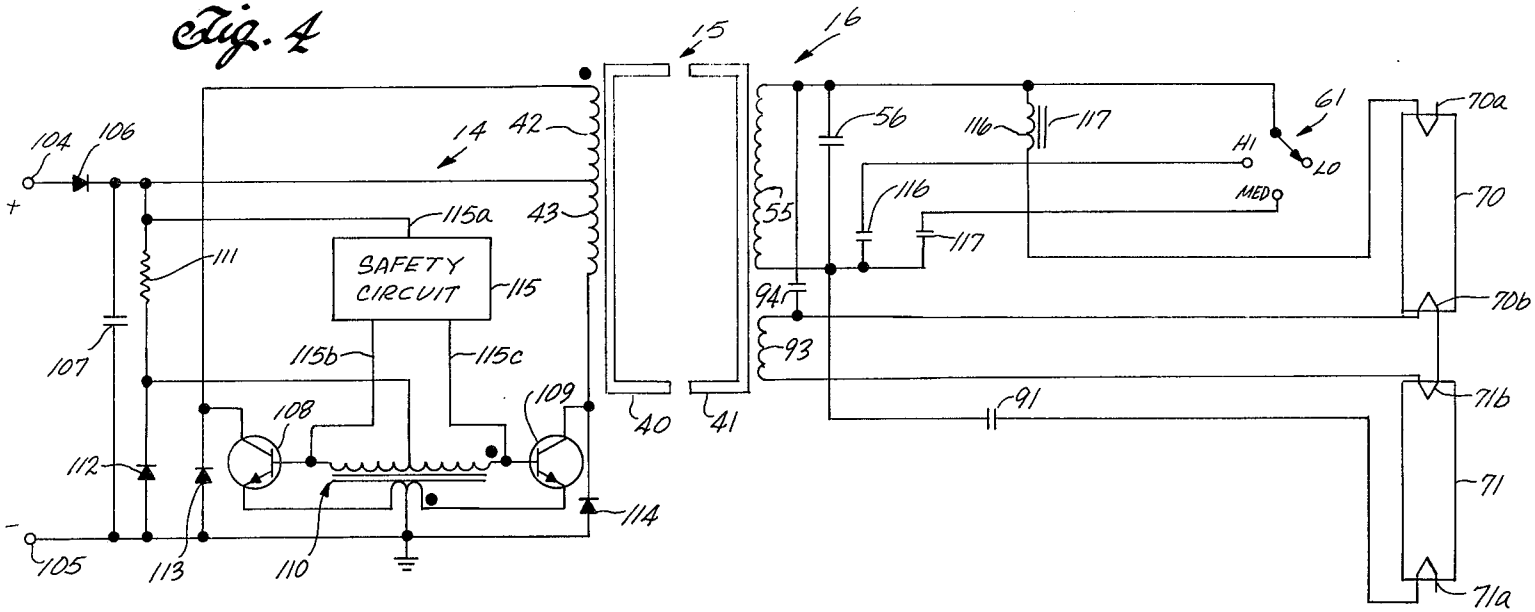
FIG. 4 is a schematic circuit diagram of yet another embodiment of a power supply for a fluorescent lamp incorporating the principles of the invention.

In the embodiments of FIGS. 2 through 4, the circuit components in common with the embodiment of FIG. 1 bear the same reference numerals.

In FIG. 2, rotary selector switches 60 and 61 each have four stationary contacts and a rotatable contact arm connectible to each of the four stationary contacts. As designated by a dashed line 62, the contact arms of switches 60 and 61 are ganged. Switches 60 and 61 permit selection of different lamp intensities, namely, OFF, LO, MED, and HI. The rotatable contact arm of switch 60 is connected to output terminal 10 and three of the stationary contacts of switch 60 are connected to input terminal 25 of rectifier 13. The remaining stationary contact of switch 60 represents the OFF position. In this embodiment, a single capacitor 63 replaces capacitors 36 and 38 in the embodiment of FIG. 1. Both output terminals of rectifier 13 are directly connected to converter 14. The rotatable contact arm of switch 61 is connected to one junction of tuning capacitor 56 and secondary winding 55. The other junction of tuning capacitor 56 and secondary winding 55 is connected to one end tap of an autotransformer 64. The other end of autotransformer 64 is connected to the HI stationary contact of switch 61. Intermediate taps of autotransformer 64 are connected, respectively, to the MED and LO stationary contacts of switch 61. Output terminal 32 is connected to one end tap of autotransformer 64 and output terminal 31 is connected to an intermediate tap near this end tap. Similarly, output terminal 34 is connected to the other end tap of autotransformer 64 and output terminal 35 is connected to an intermediate tap near this end tap. In a typical embodiment of the invention, there are seven turns between output terminals 31 and 32, 123 turns between output terminal 31 and the MED stationary contact of switch 61, 56 turns between the MED stationary contact of switch 61 and the LO stationary contact of switch 61, seven turns between the LO stationary contact of switch 61 and output terminal 35, and seven turns between output terminals 34 and 35. Autotransformer 64 serves as a voltage divider to provide selectively all or part of the voltage available across tank circuit 16 to the fluorescent lamp connected to output terminals 31, 32, 34 and 35. Typically, the lamp would produce 70 foot candles of illumination at the LO setting, 380 foot candles at the MED setting, and 700 foot candles at the HI setting. A triac 65 is connected between the end taps of autotransformer to protect against unsafe voltages when no lamp is connected to terminals 31, 32, 34 and 35. A diac 66 connects the low stationary contact of switch 61 to the control electrode of triac 65. When a safe voltage level is exceeded, triac 65 fires, thereby short circuiting autotransformer 64 and clamping its voltage to a safe level. A capacitor 67 is connected between the end taps of autotransformer 64 to increase the effective tuning capacitance across secondary winding 55 at the LO setting. This compensates for a start voltage increase at the LO setting and thus makes the voltage between filament-electrodes and the voltage between filament-electrode terminal pairs more constant over the range of lamp intensity settings.

In the embodiment of FIG. 3, fluorescent lamps 70 and 71 are energized in series by a power supply in which the same functional components described above, namely, rectifier 13, power converter 14, transformer core 15, and tank circuit 16, are connected in tandem between alternating current power output terminals 10 and 11 and lamps 70 and 71. In this embodiment, rectifier 13 is a half wave rectifier comprising a diode 72 and a filter capacitor 73 connected in series across output terminals 10 and 11. Lamps 70 and 71 are the type of fluorescent lamp having filament type electrodes that are heated to start the lamp.

Power converter 14 includes NPN transistors 74 and 75 and silicon controlled rectifiers (SCR) 76 and 77. The collector of transistor 74 is connected by primary winding 42 to the junction of diode 72 and capacitor 73, and its emitter is connected by a diode 78 and a resistor 79 in series to output terminal 11. Similarly, the collector of transistor 75 is connected by primary winding 43 to the junction of diode 72 and capacitor 73, and its emitter is connected by a diode 80 and a resistor 81 in series to output terminal 11. SCR's 76 and 77 are connected between the bases of transistors 74 and 75, respectively, and output terminal 11, poled for conduction from transistor base to output terminal 11. A feedback winding 85 connects the junction diode 76 and resistor 79 to the gating electrode of SCR 76. A feedback winding 86 connects the junction of diode 80 and resistor 81 to the gating electrode of SCR 77. Feedback winding 44 and a resistor 87 are connected in series between the bases of transistors 74 and 75. The junction of diode 72 and capacitor 73 is connected to the junction of resistor 87 and feedback winding 44 by a resistor 88, which serves to start operation of the power converter and bias the transistors. Diodes 89 and 90 are connected between the emitter and base of transistors 74 and 75, respectively, and are poled for current flow from emitter to base to protect transistors 74 and 75 from surge voltages when they are cut off. Diode 78 and 80 serve to augument the voltage drop across the base-to-emitter junction of transistors 74 and 75, respectively, so that the resultant voltage drop is larger than that across SCR's 76 and 77, respectively, when the SCR's are fired. This ensures that transistors 74 and 75 fully cut off after the corresponding SCR is fired. The described circuitry essentially operates in the manner of the power converter of FIG. 1 except that conduction of transistors 74 and 75 is terminated by SCR's 76 and 77, respectively. Specifically, when the current passing through the conducting transistor reaches a predetermined value, the voltage across the corresponding emitter resistor (79 or 81) becomes sufficient to fire the corresponding SCR (76 or 77), thereby clamping the transistor base to output terminal 11 and switching the transistor states.

One junction of secondary winding 55 and tuning capacitor 56 is connected by a capacitor 91 and a current sensing winding 92 in series to a filament-electrode **70*a* of fluorescent lamp 70. The other junction of winding 55 and capacitor 56 is directly connected to a filament-electrode 71*a* of fluorescent lamp 71. Filament electrodes 70*b* and 71*b* of fluorescent lamps 70 and 71, respectively, are connected in series across a filament heating winding 93, which is wound around core segment 41. A capacitor 94 couples one junction of winding 55 and capacitor 56 to winding 93**.

In this embodiment, selector switch 61 serves to change the shunt resistance across winding 92. When switch 61 is in the LO position as shown, a resistor 98 having a large resistance is connected across winding 92. When switch 61 is in the medium (MED) position, a resistor 99 having a small resistance and a resistor 100 having a medium resistance are connected in series and coupled across winding 92 to reduce the shunt resistance. When switch 61 is in the high position, resistor 99 is coupled across winding 92 to further reduce the shunt resistance. Winding 92 is magnetically coupled by a core 101 to windings 85 and 87 of power converter 14.

Winding 92 serves to sense the current applied to fluorescent lamps 70 and 71 and to control the operation of power converter 14 responsive thereto so as to regulate the power applied to fluorescent lamps 70 and 71. Specifically, while the lamps are starting, substantially no current flows through winding 92, and SCR's 76 and 77 do not fire until sufficient voltage for the gating electrode is generated across resistor 79 and 81, respectively. After the lamps have started, substantial current flows through winding 92 and accelerates the firing of SCRs 76 and 77, thereby reducing the power delivered by power converter 14. The extent to which the firing of SCRs 76 and 77 is accelerated depends upon the shunt resistance provided by rotary switch 61, the highest power delivery being provided by the smallest shunt resistance.

Capacitor 91 ensures balanced operation of lamps 70 and 71 during low power operation. Specifically, it prevents the lamps from ionizing on only one polarity of the alternating power.

Capacitor 94 provides a series sequence start capability for lamps 70 and 71. Specifically, before either lamp is started, capacitor 94 short circuits lamp 70 so essentially all the voltage is impressed across lamp 71. After lamp 71 has started, its impedance drops and essentially all the voltage is impressed across lamp 70 until it starts.

In FIG. 4, lamps 70 and 71 in series are energized by direct current power appearing across output terminals 104 and 105. A diode 106 is connected in series with a capacitor 107 to prevent component damage in the event the polarity of the applied direct current power is accidentally reversed. Power converter 14 includes NPN transistors 108 and 109 and a transformer 110. Transformer 110 has a primary winding connected between the emitters of transistors 108 and 109 and a secondary winding connected between the bases of transistors 108 and 109. A biasing and starting resistor 111 is connected from the junction of diode 106 and capacitor 107 to a center tap of the secondary winding of transformer 110. A center tap of the primary winding of transformer 110 is connected to output terminal 105. A diode 112 is connected between output terminal 105 and the center tap of the secondary winding of transformer 110 to provide a return path for current flowing through the base-emitter circuit of each transistor. Primary windings 42 and 43 are connected from the junction of diode 106 and capacitor 107 to the collector of transistors 108 and 109, respectively. Diodes 113 and 114 are connected between the emitter and collector of transistors 108 and 109, respectively, to protect them from surge voltage upon cut off in fashion analogous to diodes 89 and 90.

In operation, if transistor 108 is conducting, the current flowing through the secondary winding of transformer 110 induces a voltage in its primary winding of a polarity to forward bias the base-emitter junction of transistor 108 and reverse bias the base-emitter junction of transistor 109. The core of transformers 110 is designed to saturate before core 15. The emitter current of transistor 108 increases until the core of transformer 110 saturates. Diode 112 has a large charge storage capacity and, therefore, its cathode remains at a negative potential relative to its anode after saturation. This impresses a negative potential on the base of transistor 108 to cut it off. The resulting current reduction through the secondary winding of transformer 110 produces a potential that causes transistor 109 to begin conduction and repeat the described cycle.

A safety circuit 115 has a lead 115*a* connected to the junction of diode 106 and capacitor 107, a lead 115*b* connected to the base of transistor 108, and a lead 115*c* connected to the base of transistor 109. A current sensing winding 116 is connected from the junction of winding 55 and capacitor 56 to filament-electrode 70*a*. A core 117 magnetically couples sensing winding 116 to a control winding in safety circuit 115. In the absence of current through winding 116 for a predetermined period of time, safety circuit 115 short circuits the secondary winding of transformer 110 to prevent operation of power converter 114. As a result, when power is applied to terminals 104 and 105 and no lamps are connected, or when lamps although connected fail to start, safety circuit 115 turns power converter 114 off and prevents damage to the power supply due to overheating.

Rotary selector switch 61 changes the effective capacitance in parallel with winding 55. In the LO position, only capacitor 56, which has a small capacitance, is in parallel with winding 55. In the MED position, a capacitor 116 having an intermediate capacitance is connected to parallel with capacitor 56, and in the HI position, a capacitor 117 having a large capacitance is connected in parallel with capacitor 56. The effect of capacitor 116 or 117 in parallel with capacitor 56 is to detune somewhat tank circuit 16 from the frequency of the energy provided by power converter 14. Lamps 170 and 171 in series are connected to tank circuit 16 is substantially the same manner as in the embodiment of FIG. 3. Heating coil 93 heats electrode filaments 70*b* and 71*b*, capacitor 91 ensures balanced operation, and capacitor 94 provides series sequence start capability.

Figure 5:
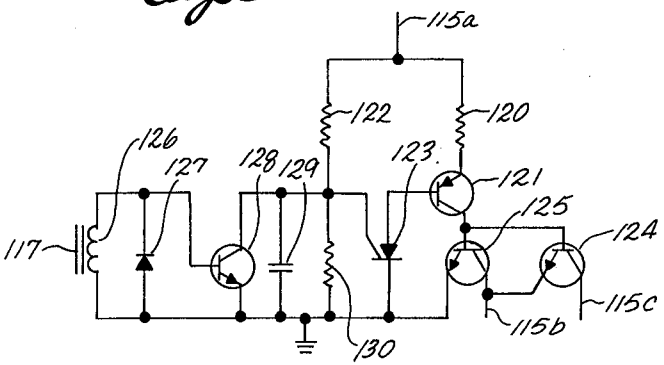
FIG. 5 is a schematic circuit diagram of the safety circuit shown in block form in FIG. 4.

In FIG. 5, one embodiment of safety circuit 115 is shown. Lead 115*a* is connected by a resistor 120 to the emitter of a PNP transistor 121, and by a resistor 122 to the gating electrode of an SCR 123, which is coupled from the base of transistor 121 to terminal 105. The bases of transistors 124 and 125 are connected to the collector of transistor 121. The collector of transistor 124 is connected to lead 115*c*, and the emitter of transistor 125 is connected to output terminal 105. The emitter of transistor 124 and the collector of transistor 125 are connected to lead 115*b*. A control winding 126 that is magnetically coupled to winding 116 by core 117 and a diode 127 are connected in parallel between the base and emitter of a transistor 128. The gate electrode of SCR 123 is connected to the collector of transistor 128, and the emitter of transistor 128 is connected to output terminal 105. A capacitor 129 and a resistor 130 are connected between the collector and emitter of transistor 128.

In operation, while alternating current flows through winding 116, transistor 128 alternately conducts and cuts off. Capacitor 129 charges through resistor 122 when transistor 128 cuts off, and discharges through transistor 128 when it conducts. When no current flows through winding 116 for the predetermined period of time, capacitor 129 charges to a sufficiently high voltage to fire SCR 123, thereby causing transistor 121 to conduct. When transistor 121 conducts, it causes transistors 124 and 125 to conduct, thereby creating a short circuit between leads 115*b* and 115*c*.

The described embodiments of the invention are only considered to be preferred and illustrative of the inventive concept; the scope of the invention is not to be restricted to such embodiments. Various and numerous other arrangements may be devised by one skilled in the art without departing from the spirit and scope of this invention. For example, instead of output terminal 34 being connected to output terminal 28, as in FIG. 1, it could be connected to an intermediate tap on secondary winding 55 to heat filament-electrode 33 while starting, as filament-electrode 30 is so heated. Further, a saturating timing inductor could be substituted for timing capacitor 49 in converter 14. Although the feature of a rectangular wave converter loosely coupled to the lamp via a tank circuit in combination with the feature of continuous application of voltage across the pair of terminals of each electrode, as well as across one or both of the electrodes themselves, is the preferred embodiment of the invention, these two features can be practiced separately, i.e., the former feature can be practiced with an instant start lamp or a rapid start lamp with a conventional, normally closed heat activated switch, and the latter feature can be practiced with conventional power handling circuitry. Further, the power reducing feedback network could be employed independently of the foregoing features.

What is claimed is:

1. A lighting system comprising:

a source of electrical power;

means for converting the electrical power from the source into rectangular waves;

a parallel tank circuit resonant near the fundamental or a harmonic of the frequency of the rectangular waves;

a fluorescent lamp having first and second electrodes, the lamp having high impedance while starting and low impedance after starting;

means for connecting the tank circuit between the first and second electrodes of the lamp; and means for magnetically coupling the converting means to the tank circuit to apply the electrical power across the first and second electrodes of the lamp, the coupling means having sufficiently loose coupling to prevent the low impedance of the lamp after starting from loading the converting means.

2. The lighting system of claim 1, in which the coupling means comprises:

a core with first and second core segments, the ends of the core segments being spaced apart to form gaps that produce loose coupling;

primary winding means that is part of the converting means and secondary winding means that is part of the parallel tank circuit wound around the core, the rectangular waves of the converting means being impressed across the primary winding means.

3. The lighting system of claim 1, in which at least one of the first and second electrodes of the fluorescent lamps has a pair of terminals across which an electrical potential is applied to heat the electrodes while starting the lamp, the connecting means applying the electrical power across the first and second electrodes while starting the lamp and after starting the lamp, and also applying the electrical power across the one pair of terminals while starting the lamp and after starting the lamp, the ratio of voltage across the first and second electrodes while starting the lamp and after starting the lamp, and also applying the electrical power across the one pair of terminals while starting the lamp and after starting the lamp, the ratio of voltage across the first and second electrodes to the voltage across the one pair of terminals being such as to prevent arcing between the one pair of terminals and arcing between the first and second electrodes while properly heating the electrodes and non-destructively starting the lamp.

4. The lighting system of claim 1, in which the tank circuit has resonant at a frequency slightly lower than the fundamental frequency of the rectangular waves.

5. The lighting system of claim 1, in which the source of electrical power is alternating current at a first frequency, and the converting means converts the electrical power to a second frequency higher than the first frequency.

6. The lighting system of claim 1, in which the converting means comprises first and second transistors and means for alternatively saturating and cutting off the first and second transistors without magnetically saturating the coupling means.

7. The lighting system of claim 1, in which the source has first and second output terminals, the first and second electrodes each have two terminals, and the connecting means comprises:

a selector switch having a movable contact and at least first and second stationary contacts;

an autotransformer having first and second end taps, a first intermediate tap near the first end tap, a second intermediate tap near the second end tap, and a third intermediate tap between the first and second intermediate taps;

means for connecting the first output terminal to the movable contact;

means for connecting the first stationary contact to the first end tap;

means for connecting the second output terminal to the second end tap;

means for connecting the second stationary contact to the third intermediate tap;

means for connecting the first end tap to one terminal of the first electrode;

means for connecting the first intermediate tap to the other terminal of the first electrode;

means for connecting the second intermediate tap to one terminal of the second electrode; and means for connecting the second end tap to the other terminal of the second electrode.

8. A lighting system comprising:

a source of electrical power;

a fluorescent lamp having first and second electrodes each with a pair of terminals across which an electrical potential is applied to heat the electrodes while starting the lamp;

first means for applying power from the source across the first and second electrodes while starting the lamp and after starting the lamp; and second means for applying power from the source across at least one pair of terminals while starting the lamp and after starting the lamp, the ratio of voltage across the first and second electrodes to the voltage across the one pair of terminals being such as to prevent arcing between the one pair of terminals and arcing between the first and second electrodes.

9. The lighting system of claim 8, in which the source has first and second output terminals and the first and second applying means comprises:

a selector switch having a movable contact and at least first and second stationary contacts;

an autotransformer having first and second end taps, a first intermediate tap near the first end tap, a second intermediate tap near the second end tap, and a third intermediate tap between the first and second intermediate taps;

first means for connecting the first output terminal to the movable contact;

second means for connecting the first stationary contact to the first end tap;

third means for connecting the second output terminal to the second end tap;

fourth means for connecting the second stationary contact to the third intermediate tap;

fifth means for connecting the first end tap to one terminal of the first electrode;

sixth means for connecting the first intermediate tap to the other terminal of the first electrode;

seventh means for connecting the second intermediate tap to one terminal of the second electrode; and eighth means for connecting the second end tap to the other terminal of the second electrode.

10. The lighting system of claim 9, in which pulsating power at a given frequency appears across the first and second output terminals and the first and third connecting means comprise:

a transformer having a primary winding connected across the first and second output terminals and a secondary winding across which the movable contact and the second end tap are connected; and a tuning capacitor connected in parallel with the secondary winding to resonate near the given frequency of the electrical power.

11. The lighting system of claim 10, additionally comprising a capacitor connected between the first and second end taps to increase the effective capacitance in parallel with the secondary winding when the movable contact engages the second stationary contact.

12. The lighting system of claim 11, in which the primary winding is part of a converter for increasing the frequency of the pulsating electrical power.

13. A power supply for a fluorescent lamp comprising:

a rectifier having a pair of input terminals adapted to receive alternating current power from a source of line voltage, a high voltage output terminal and a low voltage output terminal;

a transformer having a first primary winding, a second primary winding, a feedback winding, and a secondary winding on a common core;

a first transistor having a base, a collector connected by the first primary winding to the high voltage output terminal of the rectifier, and an emitter connected to the low voltage output terminal of the rectifier;

a second transistor having a base, a collector connected by the second primary winding to the high voltage output terminal of the rectifier, and an emitter connected to the low voltage output terminal of the rectifier;

biasing resistor means connnected between the high voltage output terminal of the rectifier and the bases of the first and second transistors;

means for connecting the feedback winding between the bases of the first and second transistors; and timing means for causing the first and second transistors to alternately saturate and cut off wth short transition times to produce rectangular waves across the primary windings;

a tuning capacitor connected in parallel with the secondary winding, the secondary winding and the tuning capacitor being resonant approximately at the frequency of the fundamental or a harmonic of the rectangular waves produced across the primary windings;

first and second lamp energizing output terminals;

means for coupling the secondary winding and tuning capacitor in parallel across the first and second output terminals; and the coupling coefficient of the core being sufficiently small so loading of the lamp energizing output terminals has no substantial effect on the transition times of the first and second transistors between saturation and cut off.

14. The power supply of claim 13, additionally comprising:

third and fourth lamp energizing output terminals;

first means for applying between the first and third output terminals a portion of the voltage between the first and second output terminals; and second means for applying between the second and fourth output terminals a portion of the voltage between the first and second output terminals.

15. The power supply of claim 14, in which the first applying means comprises an intermediate tap on the secondary winding connected to the third output terminal.

16. The power supply of claim 15, in which the second applying means comprises means for connecting the low voltage output terminal of the rectifier to the fourth output terminal and means for connecting the emitters of he transistors to the second output terminal.

17. The power supply of claim 16, additionally comprising capacitor means connected in parallel between the high and low output terminals of the rectifier, the capacitance of the capacitor means presenting a short circuit across the high and low output terminals of the rectifier at the frequency of the square wave.

18. The power supply of claim 17, in which the connecting means comprises a first filter capacitor and a second filter capacitor in parallel, the second filter capacitor being connected between the high output terminal of the rectifier and the emitters of the transistors.

19. The power supply of claim 18, in which the means for coupling the secondary winding and the tuning capacitor in parallel across the first and second output terminals comprises:

a multi-position switch having a movable contact arm engageable with a plurality of stationary contacts;

an autotransformer having a number of spaced taps exceeding the plurality of stationary contacts by one;

means connecting the junction of the tuning capacitor and the secondary winding to one of the taps of the autotransformer;

means for connecting the stationary contacts to the remaining taps of the autotransformer, respectively;

means for connecting the other junction of the tuning capacitor and the secondary winding to the movable contact arm;

means for connecting the one tap of the autotransformer to the second output terminal;

means for connecting another of the taps of the autotransformer to the first output terminal to vary the voltage applied between the first and second output terminals depending upon the stationary contact engaged by the movable contact arm.

20. The power supply of claim 13, additionally comprising a first diode connected between the emitter and base of the first transistor, the first diode being poled for conduction in a direction opposite to the emitter-to-base junction of the first transistor, and a second diode connected between the emitter and base of the second transistor, the second diode being poled for conduction in a direction opposite to the emitter-to-base junction of the second transistor.

21. The power supply of claim 13, in which the timing means comprises a timing capacitor and a charging resistor connected in series with the feedback winding between the bases of the first and second transistors.

22. The power supply of claim 13, in which the timing means comprises a first SCR having a gating electrode, the first SCR being connected between and poled for current flow in the same direction as the base and emitter of the first transistor, a first voltage generating resistor connected between the emitter of the first transistor and the low voltage output terminal, means for connecting the junction of the emitter of the first transistor and the first resistor to the gating electrode of the first SCR to fire the first SCR when the current through the first transistor exceeds a predetermined value, a second SCR having a gating electrode, the second SCR being connected between and poled for current flow in the same direction as the base and emitter of the second transistor, a second voltage generating resistor connected between the emitter of the second transistor and the low voltage output terminal, and means for connecting the junction of the emitter of the second transistor and the second resistor to the gating electrode of the second SCR to fire the second SCR when the current through the second transistor exceeds a predetermined value.

23. The power supply of claim 13, additionally comprising:

means for sensing the current applied to the first and second output terminals; and means responsive to the sensing means for adjusting the timing means to reduce the power applied to the first and second output terminals as the sensed current increases.

24. The power supply of claim 23, in which the sensing means is an inductive current sensing winding connected in series with the first and second output terminals.

25. The power supply of claim 23, in which the timing means comprises a first SCR having a gating electrode, the first SCR being connected between and poled for current flow in the same direction as the base and emitter of the first transistor, a first voltage generating resistor connected between the emitter of the first transistor and the low voltage output terminal, a first inductive control winding magnetically coupled to the sensing winding and connecting the junction of the emitter of the first transistor and the first resistor to the gating electrode of the first SCR to fire the first SCR when the difference in current through the frst transistor and the sensing winding exceeds a predetermined value, a second SCR having a gating electrode, the second SCR being connected and poled for current flow in the same direction as the base and emitter of the second transistor, a second voltage generating resistor connected between the emitter of the second transistor and the low voltage output terminal, and a second inductive control winding magnetically coupled to the sensing winding and connecting the junction of the emitter of the second transistor and the second resistor to the gating electrode of the second SCR to fire the second SCR when the difference in current through the second transistor and the sensing winding exceeds a predetermined value.

26. The lighting system of claim 1, additionally comprising a lamp intensity selector switch and means responsive to the selector switch for shunting the tank circuit with different capacitances to vary the degree of timing thereof.

27. A lighting system comprising:

a source of electrical power;

a fluorescent lamp having first and second electrodes, the lamp having high impedance while starting and low impedance after starting;

a power regulator coupling the source to the lamp adjustably to apply power from the source to the lamp, the regulator comprising a ringing choke oscillator having a frequency dependent upon an applied control voltage;

means for sensing the current applied to the lamp by the regulator, the current sensing means comprising a current sensing winding connected in series between the regulator and the lamp; and means responsive to the sensing means for adjusting the regulator to reduce the power applied to the lamp as the sensed current increases, the adjusting means comprises means for generating a control voltage for the oscillator responsive to the current flowing through the winding.

28. The lighting system of claim 27, additionally comprising a lamp intensity selector switch and means responsive to the selector switch for shunting the current sensing winding with different resistances to vary the regulator adjustment responsive to the current passing through the current sensing winding.

29. The lighting system of claim 27, in which the source has a high voltage output terminal and a low voltage output terminal, and the oscillator comprises a transformer having a first primary winding, a second primary winding, a feedback winding, and a secondary winding on a common core, a first transistor having a base, a collector connected by the first primary winding to the high voltage output terminal of the rectifier, and an emitter connected to the low voltage output terminal of the rectifier, a second transistor having a base, a collector connected by the second primary winding to the high voltage output terminal of the rectifier, and an emitter connected to the low voltage output terminal of the rectifier, biasing resistor means connected between the high voltage output terminal and the bases of the first and second transistors, means for connecting the feedback winding between the bases of the first and second transistors, and timing means for causing the first and second transistors to alternately saturate and cut off with short transition times to produce rectangular waves across the primary windings.

30. The lighting system of claim 29, in which the timing means comprises a first SCR having a gating electrode, the first SCR being connected between and poled for current flow in the same direction as the base and emitter of the first transistor, a first voltage generating resistor connected between the emitter of the first transistor and the low voltage output terminal, means for connecting the junction of the emitter of the first transistor and the first resistor to the gating electrode of the first SCR to fire the first SCR when the current through the first transistor exceeds a predetermined value, a second SCR having a gating electrode, the second SCR being connected between and poled for current flow in the same direction as the base and emitter of the second transistor, a second voltage generating resistor connected between the emitter of the second transistor and the low output terminal, and means for connecting the junction of the emitter of the second transistor and the second resistor to the gating electrode of the second SCR to fire the second SCR when the current through the second transistor exceeds a predetermined value.

31. The lighting system of claim 30, in which the first and second connecting means each comprise a control winding magnetically coupled to the current sensing winding to advance the firing of the SCR's.

* * * * *

UNITED STATES PATENT AND TRADEMARK OFFICE

CERTIFICATE OF CORRECTION

PATENT NO. : 4,237,403

DATED : December 2, 1980

INVENTOR(S) : Forrest W. Davis

It is certified that error appears in the above-identified patent and that said Letters Patent are hereby corrected as shown below:

Col. 5, line 61, "Turning" should read --Tuning--.
Col. 9, line 18, "transformers" should read --transformer--;
line 51, "to" should read --in--;
line 57, "is" should read --in--.
Col. 11, line 31, "has" should read --is--;
line 41, "alternatively" should read --alternately--.
Col. 13, line 22, "wth" should read --with--;
line 57, "he" should read --the--.
Col. 14, line 10, between "means" and "connecting" insert --for--.
Col. 15, line 19, between "connected" and "and" insert --between--;
line 52, "comprises" should read --comprising--.
Col. 16, line 44, between "low" and "output" insert --voltage--.

Signed and Sealed this

Tenth Day of March 1981

[SEAL]

Attest:

RENE D. TEGTMEYER

Attesting Officer

Acting Commissioner of Patents and Trademarks